US009885137B2

(12) United States Patent
Kim et al.

(10) Patent No.: US 9,885,137 B2
(45) Date of Patent: Feb. 6, 2018

(54) WASHING MACHINE AND METHOD OF CONTROLLING THE WASHING MACHINE

(71) Applicant: LG ELECTRONICS INC., Seoul (KR)

(72) Inventors: Kyeong Hwan Kim, Gasan-dong (KR); Il Hyeon Jo, Gasan-dong (KR); Jin Ho Chang, Gasan-dong (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 14/859,978

(22) Filed: Sep. 21, 2015

(65) Prior Publication Data

US 2016/0010267 A1 Jan. 14, 2016

Related U.S. Application Data

(62) Division of application No. 12/450,508, filed as application No. PCT/KR2008/001776 on Mar. 29, 2008, now abandoned.

(30) Foreign Application Priority Data

Mar. 31, 2007 (KR) ..... 10-2007-0032080

(51) Int. Cl.
*D06F 39/02* (2006.01)

(52) U.S. Cl.
CPC ..... *D06F 39/022* (2013.01)

(58) Field of Classification Search
CPC ..... D06F 39/022
See application file for complete search history.

(56) References Cited

U.S. PATENT DOCUMENTS 3,088,304 A 5/1963 Bochan
3,935,719 A 2/1976 Henderson
4,110,075 A 8/1978 Graf et al.
4,562,605 A * 1/1986 Quintarelli ..... D06F 39/022 239/214
5,345,637 A 9/1994 Pastryk et al.
(Continued)

FOREIGN PATENT DOCUMENTS

CN 1228490 A 9/1999
CN 2372345 Y 4/2000
(Continued)

OTHER PUBLICATIONS

Machine Translation of JP 0768082 to Sato, Mar. 1995.*
U.S. Appl. No. 12/450,508, filed Sep. 29, 2009.

*Primary Examiner* — Michael Barr
*Assistant Examiner* — Benjamin L Osterhout
(74) *Attorney, Agent, or Firm* — Dentons US LLP

(57) ABSTRACT

A washing machine and a method of controlling the washing machine are provided. In the washing machine and the method of controlling the washing machine, a liquid detergent is automatically supplied into a washing tub, thereby improving user convenience. In addition, in the washing machine and the method of controlling the washing machine, a liquid detergent is supplied into the washing tub by water circulated by a circulation unit. Thus, no liquid detergent remains in a liquid detergent supply path, and the liquid detergent supply path can be prevented from being blocked due to the solidification of a liquid detergent.

2 Claims, 6 Drawing Sheets

(56) References Cited

U.S. PATENT DOCUMENTS

| | | | | |
|---|---|---|---|---|
| 5,768,730 | A * | 6/1998 | Matsumoto | D06F 25/00 210/144 |
| 7,047,987 | B2 * | 5/2006 | Cerruti | A47L 15/4409 134/58 D |
| 2005/0275325 | A1 * | 12/2005 | Yang | 312/330.1 |
| 2006/0000240 | A1 * | 1/2006 | Song | D06F 39/085 68/3 R |
| 2006/0162393 | A1 * | 7/2006 | Kwon | D06F 39/028 68/17 R |
| 2007/0000292 | A1 * | 1/2007 | Park | D06F 39/007 68/13 A |
| 2007/0022788 | A1 * | 2/2007 | Choi | D06F 39/02 68/17 R |
| 2007/0056330 | A1 * | 3/2007 | Song | D06F 39/02 68/17 R |

FOREIGN PATENT DOCUMENTS

| | | | |
|---|---|---|---|
| DE | 32 38 529 A1 | | 4/1984 |
| DE | 87 11 341 U1 | | 9/1988 |
| GB | 2 127 045 A | | 9/1982 |
| JP | 53-051768 | | 5/1978 |
| JP | 63-125979 | | 8/1988 |
| JP | 3-024081 | | 3/1991 |
| JP | 4-220293 | | 8/1992 |
| JP | 7-068081 | | 3/1995 |
| JP | 7-068082 | | 3/1995 |
| JP | 0768082 | * | 3/1995 |
| JP | 11-290581 | | 10/1999 |

* cited by examiner

[Fig. 1]
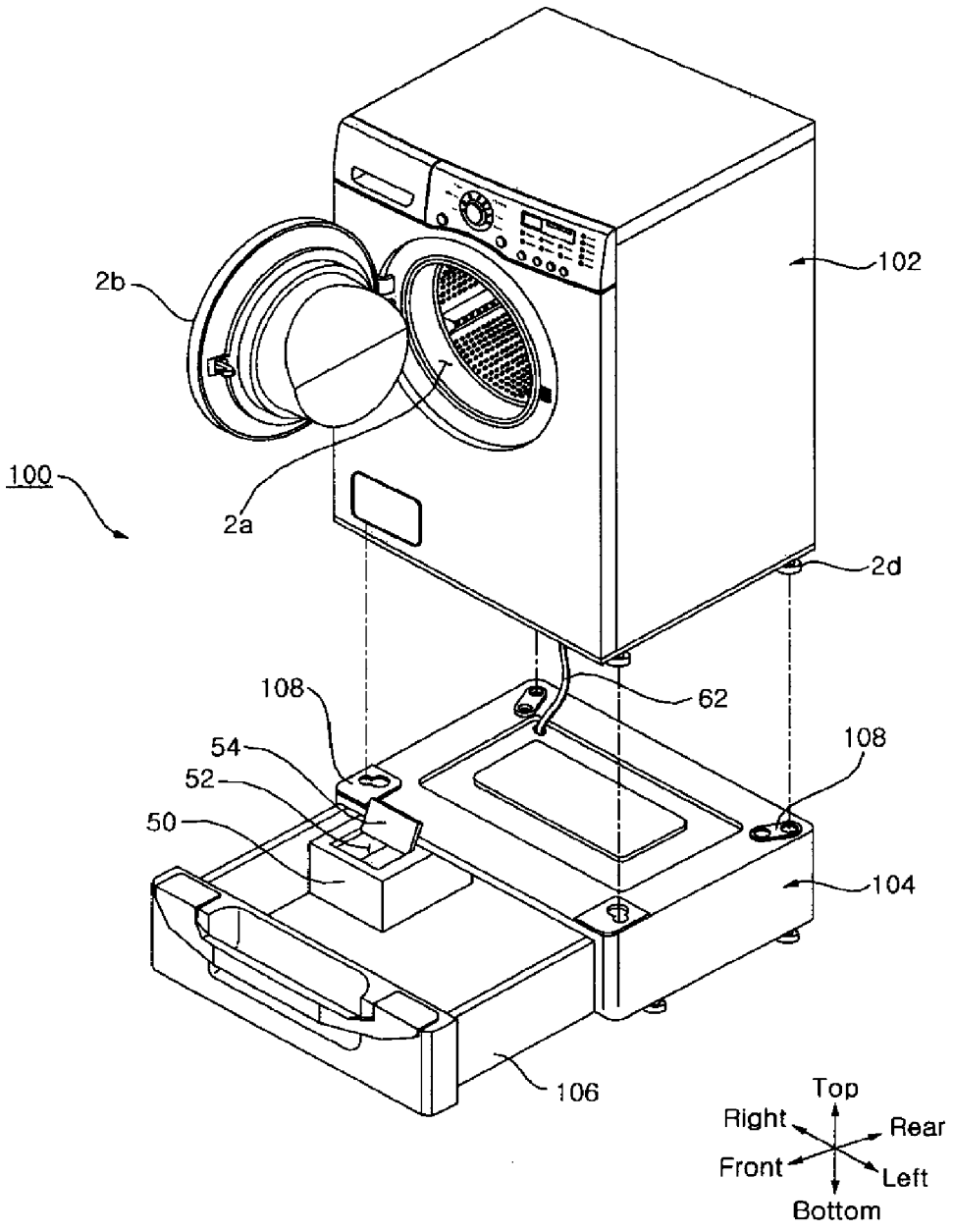

[Fig. 2]
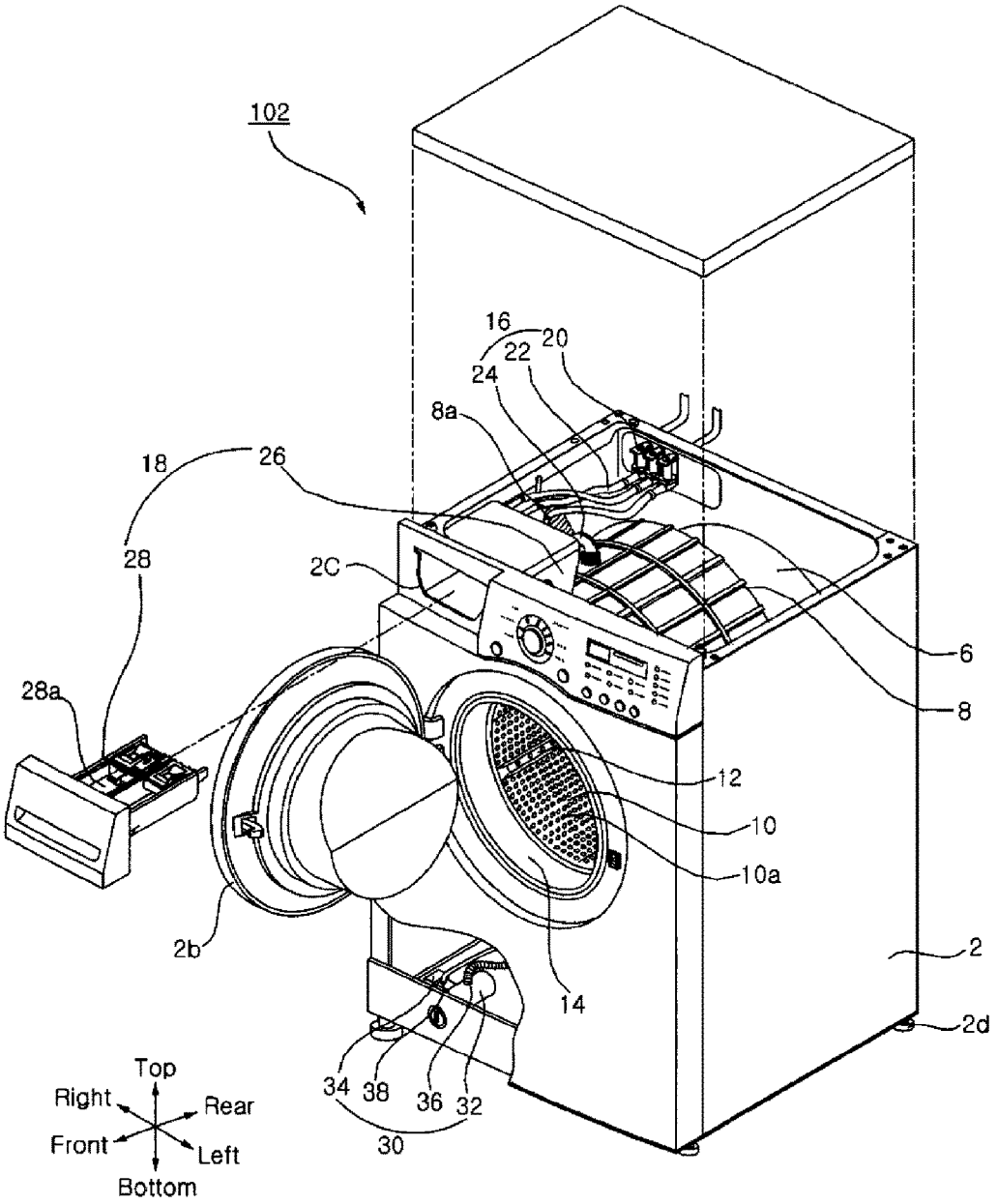

[Fig. 3]
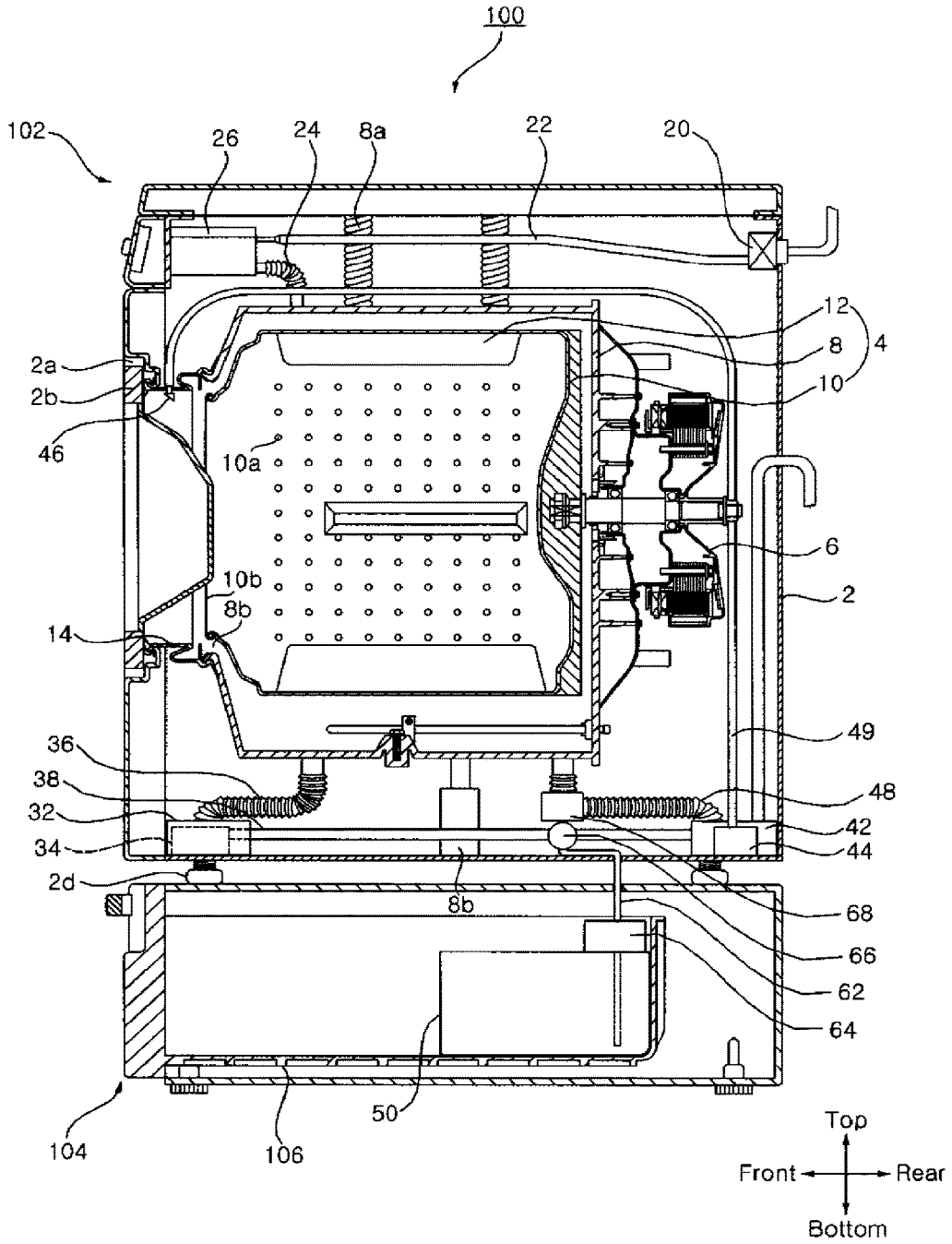

[Fig. 4]
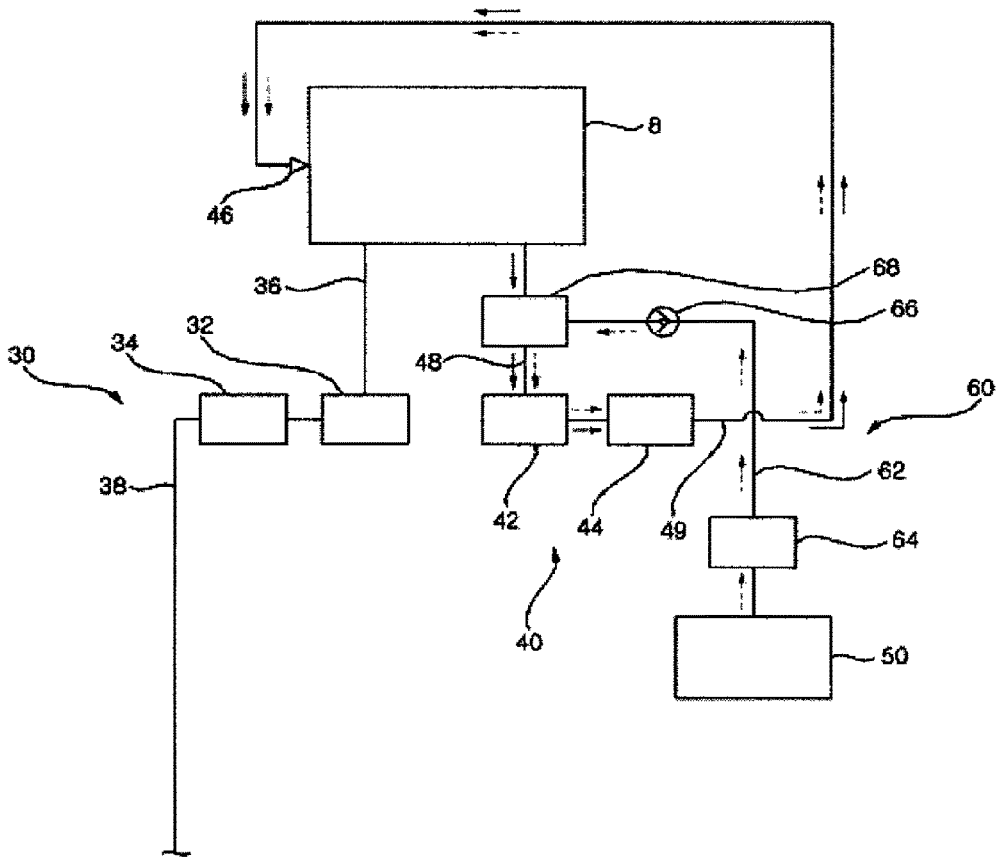

[Fig. 5]
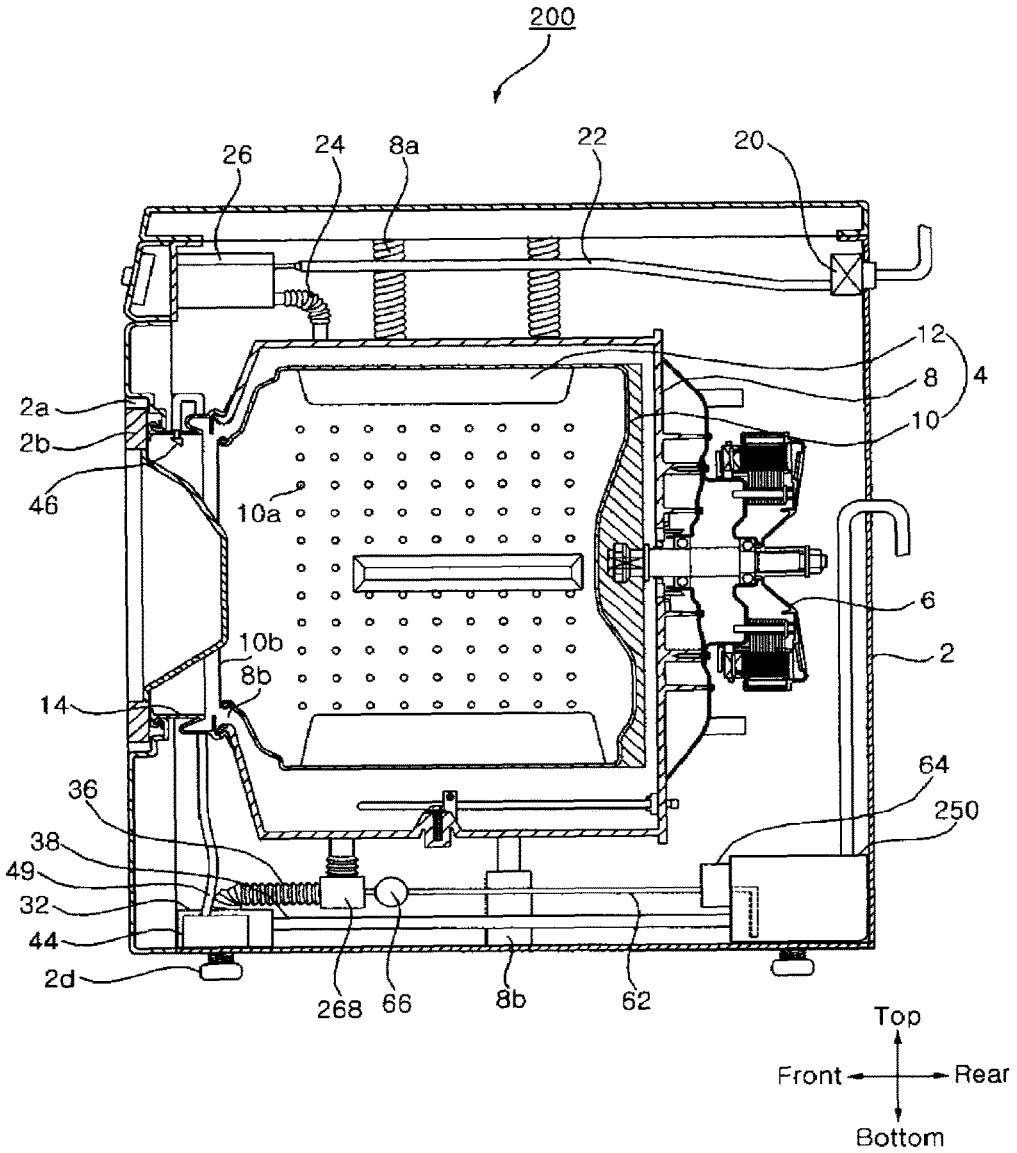

[Fig. 6]
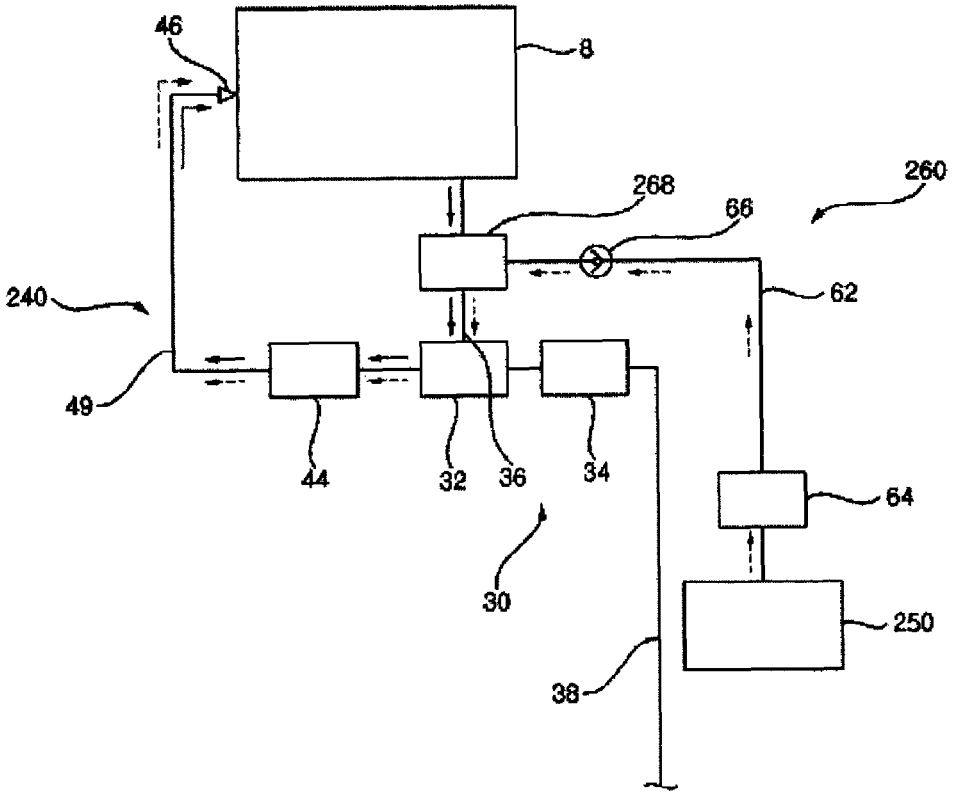

WASHING MACHINE AND METHOD OF CONTROLLING THE WASHING MACHINE

This application is a divisional of U.S. application Ser. No. 12/450,508 filed on Sep. 29, 2009; which is a 35 USC § 371 National Stage entry of International Application No. PCT/KR2008/001776, filed Mar. 29, 2008, and claims the benefit of Korean Application No. 10-2007-0032080 filed Mar. 31, 2007, all of which are incorporated by reference in their entirety herein.

TECHNICAL FIELD

The present invention relates to a washing machine and a method of controlling the washing machine, and more particularly, to a washing machine which can automatically supply a liquid detergent into a washing tub while preventing the liquid detergent from remaining in a liquid detergent supply path, and a method of controlling the washing machine.

BACKGROUND ART

In general, washing machines remove dust and dirt from clothing by performing a mechanical operation using water and a detergent. In recent years, an increasing number of washing machines have been equipped with a drier function for drying wet laundry with the use of a mechanical operation and hot wind generated by a heater.

A typical washing machine includes a washing tub, which is rotatably installed in the typical washing machine and can contain water and laundry therein. The typical washing machine performs a washing operation on laundry contained in the washing tub by rotating the washing tub with the aid of a driving unit. The typical washing machine also includes a water supply unit which supplies water into the washing tub, and a drainage unit which drains water from the washing tub. A detergent supply unit, which supplies a detergent into the washing tub, is disposed on a water supply path of the water supply unit. The detergent supply unit includes a dispenser which is connected to the water supply path and a detergent box which is installed so as to be able to be inserted into or ejected from the dispenser. Therefore, in order to supply a powder detergent or a liquid detergent into the washing tub, the detergent box may be taken out from the dispenser, a powder detergent or a liquid detergent may be injected into the detergent box, and the detergent box may be put back in the disperser. Then, if the water supply unit begins to operate, the powder detergent or the liquid detergent contained in the detergent box may be supplied into the washing tub along with water that flows along the water supply path of the water supply unit.

Conventionally, however, users are required to put a liquid detergent into a detergent box whenever necessary for a washing operation, thereby causing inconvenience and reducing the convenience of the use of a washing machine.

DISCLOSURE OF INVENTION

Technical Problem

The present invention provides a washing machine which can automatically supply a liquid detergent into a washing tub while preventing the liquid detergent from remaining in a liquid detergent supply path, and a method of controlling the washing machine.

Technical Solution

According to an aspect of the present invention, there is provided a washing machine including a washing tub which contains laundry and water therein; a circulation unit which circulates the water in the washing tub; a liquid detergent container which contains a liquid detergent to be supplied into the washing tub; and a liquid detergent supply unit which supplies the liquid detergent into the circulation unit and injects a mixture of the liquid detergent and the water circulated by the circulation unit into the washing tub.

According to another aspect of the present invention, there is provided a washing machine including a washing tub which contains water therein; a water supply path along which water is supplied from an external water source into the washing tub; a liquid detergent container which contains a liquid detergent; a circulation unit which circulates the water in the washing tub; and a circulation path along which a mixture of the liquid detergent and the water circulated by the circulation unit is supplied into the washing tub.

According to another aspect of the present invention, there is provided a method of controlling a washing machine, the method including supplying water into a washing tub; and discharging the water from the washing tub, mixing the discharged water with a liquid detergent in a liquid detergent container and injected the mixture of the discharged water and the liquid detergent into the washing tub.

According to the present invention, it is possible to improve user convenience by automatically supplying a liquid detergent into a washing tub. In addition, it is possible to prevent a liquid detergent from remaining in a liquid detergent supply path and prevent the liquid detergent supply path from being blocked due to the solidification of a liquid detergent by supplying a liquid detergent into a washing tub with the use of water circulated by a circulation unit.

Moreover, according to the present invention, it is possible to prevent a waste of liquid detergent and the deterioration of the performance of a washing machine by precisely controlling the amount of liquid detergent supplied into a washing tub.

BRIEF DESCRIPTION OF THE DRAWINGS

The above and other features and advantages of the present invention will become more apparent by describing in detail preferred embodiments thereof with reference to the attached drawings in which:

FIG. 1 illustrates a perspective view of a drum-type washing machine according to an embodiment of the present invention;

FIG. 2 illustrates a partially exploded perspective view of a main body of the drum-type washing machine illustrated in FIG. 1;

FIG. 3 illustrates a cross-sectional view of the drum-type washing machine illustrated in FIG. 1;

FIG. 4 illustrates a block diagram of the drum-type washing machine illustrated in FIG. 1;

FIG. 5 illustrates a cross-sectional view of a drum-type washing machine according to another embodiment of the present invention; and FIG. 6 illustrates a block diagram of the drum-type washing machine illustrated in FIG. 5.

MODE FOR THE INVENTION

The present invention will hereinafter be described in detail with reference to the accompanying drawings in which exemplary embodiments of the invention are shown.

FIGS. 1 through 4 illustrate diagrams of a drum-type washing machine 100 according to an embodiment of the present invention. Referring to FIG. 1, the drum-type washing machine 100 includes a main body 102 which performs a washing operation on laundry; and a frame 104 which is disposed on one side of the main body 102 and contains various stuffs necessary for the use of the main body 102.

A laundry inlet/outlet hole 2*a*, through which laundry can be injected into or ejected from the main body 102, is formed at the front of the main body 102. A door 2*b* is rotatably installed so as to be able to open or close the laundry inlet/outlet hole 2*a*. A plurality of legs 2*d*, which support the main body 102, are formed at the bottom of the main body 102. A drawer-type container 106 is installed so as to be able to slide in and out of the frame 104. The drawer-type container 105 may be ejected forward from the frame 104.

The frame 104 may be selectively disposed on the top, the bottom, a left side, a right side, or a rear side of the main body 102. In the embodiment of FIGS. 1 through 4, the frame 104 is disposed below the main body 102. A plurality of leg settling units 108 respectively corresponding to the legs 2*d* are formed on the top of the frame 104. Once the main body 102 is mounted on the frame 104, the laundry inlet/outlet hole 2*a* is lifted up by as much as the height of the frame 104, and thus a user can easily access the main body 102. Therefore, the frame 104 not only contains various goods but also lifts up the main body 102 to the extent that the convenience of the use of the main body 102 can be improved.

Referring to FIGS. 2 and 3, the main body 102 includes a case 2 which forms the exterior of the main body 102, a washing tub 4 which is rotatably installed in the case 2 and contains laundry, a detergent and water, and a driving unit 6 which drives the washing tub 4.

The washing tub 4 may include a tub 8 which is installed so as to be able to be buffered by a spring 8*a* and a damper 8*c* and contains water and a detergent therein; a drum 10 which is rotatably installed in the tub 8, contains laundry and includes a plurality of water holes 10*a* through which water and a detergent contained in the tub 8 can pass; and a lifter 12 which is disposed in the drum 10 and lifts up and drops laundry during the rotation of the drum 10.

An opening 8*b* is formed at the front of the tub 8, and an opening 10*b* is formed at the front of the drum 10. The laundry inlet/outlet hole 2*a* is formed at the front of the case 2 and faces the openings 8*b* and 10*b*. The door 2*b* is rotatably installed at the front of the case 2. A gasket 14 is disposed between the opening 8*b* of the tub 8 and the laundry inlet/outlet hole 2*a*. The gasket 14 alleviates shock caused by the rotation of the drum 10 and prevents a water spill.

Referring to FIGS. 2 and 3, the main body 102 also includes a water supply unit 16 which is disposed above the tub 8 and supplies water into the tub 8; and a detergent supply unit 18 which is disposed on a water supply path of the water supply unit 16 and supplies a detergent into the tub 8.

The water supply unit 16 includes a plurality of water supply valves 20 which are disposed in the case 2 and are connected to an external water source, and the water supply path which connects the water supply valves 20 and the tub 8 and guides water into the tub 8. The water supply path includes a plurality of first water supply hoses 22 which connect the respective water valves 20 to the detergent supply unit 18 and a second water supply hose 24 which connects the detergent supply unit 18 and the tub 8.

The detergent supply unit 18 is provided with a detergent by a user before the operation of the drum-type washing machine 100 and supplies the detergent into the tub 8 during the operation of the drum-type washing machine 100. The detergent supply unit 18 includes a dispenser 26 and a detergent box 28 which is installed in the dispenser 26 so as to be able to be inserted into or ejected from the dispenser 26 and includes a plurality of detergent containers 28*a* into which a detergent can be supplied by the user. The first water supply hoses 22 are connected to the top of the dispenser 26, and the second water supply hose 24 is connected to the bottom of the dispenser 26. The dispenser 26 has an open front and is connected to a hole 2*c*, which is formed at the front of the case 2. The detergent box 28 is disposed so as to be able to be inserted into or ejected from the dispenser 26 through the hole 2*c* of the case 2. Therefore, the dispenser 26 selectively distributes water supplied thereto through the first water supply hoses 22 among the detergent containers 28*a* and then supplies water mixed with a detergent in the detergent containers 28*a* into the tub 8 through the second water supply hose 24. A powder detergent, a liquid detergent or both may be supplied into the detergent supply unit 18.

Referring to FIGS. 2, 3 and 4, the main body 102 also includes a drainage unit 30, which is disposed below the tub 8 and drains water and a detergent from the tub 8. The drainage unit 30 includes a drain path which guides water in the tub 8 to the outside of the case 2; a drain filter 32 which is disposed on the drain path and removes foreign materials from drain water; and a drain pump 34 which is disposed in the drain filter 32 and flows water along the drain path. The drain path includes a first drain hose 36 which connects a lower portion of the tub 8 and the drain filter 32 and a second drain hose 38 which has one end connected to the drain filter 32 and the other end disposed outside the case 2.

Referring to FIGS. 3 and 4, the main body 102 also includes a circulation unit 40 which is disposed on one side of the tub 8 and circulates water in the tub 8. Due to the circulation unit 40, laundry in the drum 10 can be evenly soaked with water within a relatively short time. The circulation unit 40 includes a circulation path which connects both end portions of the tub 8 at different heights; a circulation filter 42 which removes foreign materials from water that flows along the circulation path; a circulation pump 44 which is disposed in the circulation filter 42 and circulates water in the tub 8 so as to flow along the circulation path; and a circulation nozzle 46 which is disposed on one side of the circulation path, from which water is discharged, and injects water into the tub 8.

The circulation pump 44 is driven when the tub 8 is filled with a certain amount of water by the water supply unit 16, and forcefully circulates the water in the tub 8 from one end to the other end of the circulation path. The circulation nozzle 46 is formed through the top of the gasket 14 and thus sprinkles water supplied thereto from the circulation path on laundry. The circulation nozzle 46 may be optional. The circulation nozzle 46 may be installed directly at the tub 8. The circulation path includes a first circulation hose 48 which connects the lower portion of the tub 8 and the circulation filter 42 and a second circulation hose 49 which has one end connected to the circulation filter 42 and the other end connected to the circulation nozzle 46.

Referring to FIGS. 1 and 3, the frame 104 also includes at least one liquid detergent container 50 which contains at least one type of liquid detergent to be supplied into the tub 8. The liquid detergent container 50 is disposed in the drawer-type container 106. A number of liquid detergent containers 50 corresponding to the number of types of liquid detergents used in a washing operation may be provided in the drum-type washing machine 100. In the embodiment of FIGS. 1 through 4, only one liquid detergent container 50 is provided in the drum-type washing machine 100, and only one type of liquid detergent is used in a washing operation performed by the drum-type washing machine 100. The liquid detergent container 50 includes an injection hole 52 which is formed on the top of the liquid detergent container 50 and through which a liquid detergent is injected into the liquid detergent container 50. A cover 54 is formed so as to be able to open and close the injection hole 52. When the drawer-type container 106 is ejected from the dispenser 108, the injection hole 52 is completely exposed.

Referring to FIGS. 3 and 4, the drum-type washing machine 100 also includes a liquid detergent supply unit 60 which automatically supplies a liquid detergent contained in the liquid detergent container 50 into the tub 8. The liquid detergent supply unit 60 automatically supplies an appropriate amount of liquid detergent into the tub 8 according to the amount of laundry in the drum 10. Therefore, the supply of a detergent by the detergent supply unit 18 may not be performed.

Referring to FIGS. 1, 3 and 4, the liquid detergent supply unit 60 includes a liquid detergent supply path 62 which connects the liquid detergent container 50 and the circulation unit 40; and a liquid detergent supply pump 64 which is disposed on the liquid detergent supply path 62.

The liquid detergent supply path 62 has a first end connected to the liquid detergent container 50 in the frame 104 and a second end connected to the circulation path of the circulation unit 40 in the main body 102. The second end of the liquid detergent supply path 62 is connected to the first circulation hose 48, which is less affected by pressure caused by the circulation pump 44 during the operation of the circulation unit 40. Alternatively, the second end of the liquid detergent supply path 62 may be connected to the circulation pump 44 or the circulation nozzle 46.

The liquid detergent supply path 62 passes through the top of the frame 104 and the bottom of the main body 102. Therefore, the liquid detergent supply path 62 may be divided into more than one portion that can be selectively connected to or disconnected from each other, thereby facilitating the installation of the liquid detergent supply path 62 in the drum-type washing machine 100. The liquid detergent supply path 62 may be formed as a hose having a sufficient length to not interfere with the ejection of the drawer-type container 106.

The liquid detergent supply pump 64 pumps a liquid detergent out of the liquid detergent container 50, which is disposed below the tub 8, and thus forcefully flows the liquid detergent into the circulation unit 40 through the liquid detergent supply path 62. The liquid detergent supply pump 64 is disposed in the frame 104. The liquid detergent supply pump 64 may be disposed in the main body 102.

The amount of liquid detergent supplied by the liquid detergent supply unit 60 is controlled according to the number of revolutions per minute of the liquid detergent supply pump 64 and the duration of the operation of the liquid detergent supply pump 64. In the embodiment of FIGS. 1 through 4, the number of revolutions per minute of the liquid detergent supply pump 64 is uniformly maintained, and thus, the amount of liquid detergent supplied by the liquid detergent supply pump 64 is determined according to the duration of the operation of the liquid detergent supply pump 64. That is, once the amount of liquid detergent to be supplied is set according to the amount of laundry injected into the drum 10 and a washing course, the liquid detergent supply pump 64 is continuously driven for an amount of time corresponding to the set amount of liquid detergent, and thus, the set amount of liquid detergent can be supplied into the tub 8.

Referring to FIGS. 3 and 4, the liquid detergent supply unit 60 also includes a check valve 66, which is disposed on the liquid detergent supply path 62 and limits the direction of the flow of a liquid detergent from the liquid detergent container 50 to the circulation unit 40. That is, the check valve 66 prevents water and foreign materials in the first circulation hose 48 from flowing into the liquid detergent container 50 along the liquid detergent supply path 62 during the operation of the circulation unit 40. The check valve 66 is disposed between the liquid detergent supply pump 64 and the circulation unit 40 in order to prevent the operating pressure of the circulation unit 40 from affecting the liquid detergent supply pump 64. Thus, it is possible to reduce damage to the liquid detergent supply pump 64, caused by pressure generated during the operation of the circulation unit 40.

Referring to FIGS. 3 and 4, the liquid detergent supply unit 60 also includes a liquid detergent mixer 68, which is connected to the connection between the liquid detergent supply path 62 and the circulation unit 40 and mixes a liquid detergent with water. The liquid detergent mixer 68 is formed as a cylinder having an empty space therein. The liquid detergent mixer 68 is connected to the liquid detergent supply path 62, and thus, a liquid detergent that flows along the liquid detergent supply path 62 can be injected into the liquid detergent mixer 68. In addition, the liquid detergent mixer 68 is connected to a middle portion of the first circulation hose 48, and thus, water that flows along the first circulation hose 48 can be injected into the liquid detergent mixer 68 and mixed with the liquid detergent injected into the liquid detergent mixer 68. Then, the liquid detergent mixer 68 supplies a liquid detergent completely dissolved in water into the drum 10 through the circulation nozzle 46.

As the difference between the height of the liquid detergent mixer 68 and the height of the liquid detergent container 50 increases, the pump head of the liquid detergent supply pump 64 increases. Accordingly, the required capacity of the liquid detergent supply pump 64 increases, and the manufacturing cost of the liquid detergent supply pump 64 increases. Therefore, the liquid detergent mixer 68 may be disposed between the tub 8 and the liquid detergent container 8 so as to be as close as possible to the liquid detergent container 50.

The operation of the drum-type washing machine 100 will hereinafter be described in detail. Assume that the detergent supply unit 18 supplies no detergent, and that the liquid detergent supply unit 60 supplies a liquid detergent instead.

Laundry is injected into the drum 10 through the laundry inlet/outlet hole 2*a* of the main body 102, and the door 2*b* is closed so that the laundry inlet/outlet hole 2*a* can be sealed. Then, the main body 102 is driven. The main body 102 detects the amount of laundry injected into the drum 10, and sets a feed-water level, an amount of detergent to be supplied, and a washing time.

Thereafter, the water supply unit 16 is driven and thus supplies water into the tub 8 until reaching the set feed-water level. More specifically, the water supply valve 20 of the water supply unit 16 is opened so that water can be injected from an external water source into the drum-type washing machine 100 through the water supply valve 20 and then supplied into the tub 8 through the first water supply hose 22, the detergent supply unit 18, and the second water supply hose 24. And at the same time, the liquid detergent supply unit 60 supplies the set amount of detergent into the tub 8. More specifically, when the liquid detergent supply pump 64 of the liquid detergent supply unit 60 is driven, the liquid detergent supply pump 64 pumps a liquid detergent out of the liquid detergent container 50 so that the liquid detergent can be injected into the liquid detergent mixer 68 along the liquid detergent supply path 62.

Thereafter, the circulation unit 40 is driven so that the water injected into the tub 8 can circulate, and that the liquid detergent in the liquid detergent mixer 68 can be supplied into the tub 8.

Thereafter, the driving unit 6 is driven so that the drum 10 can rotate for a predefined amount of time. Accordingly, a washing operation is performed while repeatedly lifting up and dropping the laundry with the use of the rotation of the drum 10 and the lifter 12.

Once the washing operation is complete, the operation of the driving unit 6 is terminated, and the drainage unit 30 is driven and thus drains water from the tub 8. Thereafter, the water supply unit 16 is driven and thus supplies water into the tub 8 until reaching the set feed-water level. Thereafter, the driving unit 6 is driven and thus rotates the drum 10 again, thereby performing a rinsing operation.

Once the rinsing operation is complete, the operation of the driving unit 6 is terminated, and the drainage unit 30 is driven and thus drains water from the tub 8. Thereafter, if the tub 8 is completely drained, the driving unit 6 is driven and thus rotates the drum 10 at high speed, and then, the operation of the drum-type washing machine 100 is terminated. When the drum 10 is rotated at high speed, water drains from the laundry, and water collected in the tub 8 is discharged by the drainage unit 30.

The supply of a liquid detergent as performed in the drum-type washing machine 100 will hereinafter be described in detail with reference to FIG. 4. Referring to FIG. 4, solid-line arrows indicate water flow caused by the circulation unit 40, and dotted-line arrows indicate water flow caused by the liquid detergent supply unit 60.

Referring to FIG. 4, the liquid detergent supply pump 64 is driven and thus pumps a liquid detergent out of the liquid detergent container 50. Then, the liquid detergent flows along the liquid detergent supply path, and thus, a predefined amount of liquid detergent is supplied into the liquid detergent mixer 68.

The amount of liquid detergent supplied by the liquid detergent supply pump 64 may be determined indirectly based on the duration of the operation of the liquid detergent supply pump 64. Therefore, if the duration of the operation of the liquid detergent supply pump 64 is more than a predefined amount of time, the operation of the liquid detergent supply pump 64 is terminated. The predefined amount of time may be set according to the amount of laundry, a washing course and the type of liquid detergent used in the drum-type washing machine 100. Alternatively, the amount of liquid detergent supplied by the liquid detergent supply pump 64 may be measured by installing a water level sensor or a weight sensor in the liquid detergent container 50. If an appropriate amount of liquid detergent is injected into the liquid detergent mixer 68, it is determined whether a current water level in the tub 8 is appropriate for a circulation operation. If the current water level in the tub 8 is appropriate for a circulation operation, the circulation unit 40 may be driven.

When the circulation unit 40 is driven, the water in the tub 8 is injected into the circulation pump 44 through the first circulation hose 48. Then, the water injected into the circulation pump 44 is injected into the liquid detergent mixer 68 through the first circulation hose 48. The liquid detergent contained in the liquid detergent mixer 68 dissolves in and mixes with the water injected into the liquid detergent mixer 68, and then the mixture is injected into the circulation pump 44. The mixture flows to the circulation nozzle 46 along the second circulation hose 49 and then is injected into the drum 10.

In the embodiment of FIGS. 1 through 4, the liquid detergent supply unit 60 and the circulation unit 40 supply a liquid detergent mixed with water into the tub 8 and thus prevent laundry in the drum 10 from directly contacting a liquid detergent. Therefore, it is possible to prevent laundry from being damaged or decolorized due to directly contacting a liquid detergent. In addition, in the embodiment of FIGS. 1 through 4, a liquid detergent is supplied into the tub 8 along with water circulated by the circulation unit 40, and thus, no liquid detergent remains in the liquid detergent supply unit 50 and the circulation unit 40. Therefore, since a liquid detergent only remains in the tub 8, it is possible to supply an appropriate amount of liquid detergent into the tub 8, to prevent the liquid detergent supply path 62 of the liquid detergent supply unit 60 and the circulation path of the circulation unit 40 from being blocked due to the solidification of a liquid detergent remained therein.

FIG. 5 illustrates a cross-sectional view of a drum-type washing machine 200 according to another embodiment of the present invention, and FIG. 6 illustrates a block diagram of the drum-type washing machine 200. In FIGS. 1 through 6, like reference numerals indicate like elements, and thus detailed descriptions thereof will be skipped. The drum-type washing machine 200 will hereinafter be described, mainly focusing on the differences with the drum-type washing machine 100.

Referring to FIGS. 5 and 6, the drum-type washing machine 200 is different from the drum-type washing machine 100 in that the drum-type washing machine 200 does not include a frame, that a circulation unit 240 and a drainage unit 30 share some elements, and that a liquid detergent container 250 is disposed in a case 2 of the drum-type washing machine 200. Referring to FIG. 6, solid-line arrows indicate water flow caused by the circulation unit 240, and dotted-line arrows indicate water flow caused by a liquid detergent supply unit 260.

The drainage unit 30, like the drainage unit 30 of the drum-type washing machine 100, includes a drain pump 34, a drain filter 32, a first drain hose 36, and a second drain hose 38. The circulation unit 240, like the circulation unit 40 of the drum-type washing machine 100, includes a circulation pump 44, a second circulation hose 49, and a circulation nozzle 46. However, the circulation unit 240, unlike the circulation unit 40 of the drum-type washing machine 100, uses the drain filter and the first drain hose 36 of the drainage unit 30 as a circulation filter and a first circulation hose. That is, the drain filter 32 performs the functions of the circulation filter 42 of the circulation unit 40 of the drum-type washing machine 100, and the first drain hose 36 performs the functions of the first circulation hose 48 of the circulation unit 40 of the drum-type washing machine 100. By sharing the drain filter 32 and the first drain hose 36 between the drainage unit 30 and the circulation unit 240, it is possible to simplify the structure of the drum-type washing machine 200, to reduce the number of elements of the drum-type washing machine 200 and thus to reduce the manufacturing cost of the drum-type washing machine 200.

At least one liquid detergent container 250 may be disposed in the case 2 of the drum-type washing machine 200. In the embodiment of FIGS. 5 and 6, only one liquid detergent container 250 is disposed in the case 2. The liquid detergent supply unit 260 includes a liquid detergent mixer 268 which is disposed at a middle portion of the first drain hose 36, a liquid detergent supply path 62 which is connected to the liquid detergent mixer 268 and the liquid detergent container 250, and a liquid detergent supply pump 64 which is disposed on the liquid detergent supply path 62.

An appropriate amount of liquid detergent may be supplied into the liquid detergent mixer 268 by the liquid detergent supply unit 260, and then, the liquid detergent contained in the liquid detergent mixer 268 may be supplied into the drum 10 by the circulation unit 240. Since a liquid detergent is supplied into the tub 8 along with water circulated by the circulation unit 240, no liquid detergent remains in the liquid detergent mixer 268. Even if a liquid detergent is not completely washed out from the liquid detergent mixer 268 by the water circulated by the circulation unit 240 and thus remains in the liquid detergent mixer 268, the liquid detergent remained in the liquid detergent mixer 268 may be discharged during a drainage operation performed by the drainage unit 30.

The present invention is not restricted to the embodiments set forth herein. In addition, the present invention is not restricted to a drum-type washing machine. That is, the present invention can be applied to a water stream-type washing machine.

In the present invention, if a liquid detergent container is disposed above a tub, a liquid detergent supply pump may be optional because a liquid detergent can be automatically supplied into the tub due to gravity. In addition, in the present invention, a liquid detergent mixer may not be provided. Then, a liquid detergent may be directly supplied into a circulation path of a circulation unit.

While the present invention has been particularly shown and described with reference to exemplary embodiments thereof, it will be understood by those of ordinary skill in the art that various changes in form and details may be made therein without departing from the spirit and scope of the present invention as defined by the following claims.

The invention claimed is:

1. A method of controlling a washing machine, the method comprising:

opening a water supply valve to supply water from an external water source into a washing tub; and operating a liquid detergent supply pump to supply a liquid detergent from the liquid detergent container into a liquid detergent mixer which is connected to a middle portion of a circulation path; and operating a circulation pump, when the supplying the water and supplying the liquid detergent are completed, to discharge the water from the washing tub to the circulation path and inject the water into the washing tub, wherein the water supply valve is opened and the liquid detergent supply pump is operated at the same time, and wherein the liquid detergent in the liquid detergent mixer is supplied into the washing tub along with the water circulated through the circulation path right after operating the circulation pump.

2. The method of claim 1, wherein the circulation pump is started to operate when a predetermined amount of liquid detergent is injected into the liquid detergent mixer and a current water level in the washing tub reaches predetermined water level for a circulation operation.

* * * * *